US011253077B2

(12) United States Patent
Yajima et al.

(10) Patent No.: US 11,253,077 B2
(45) Date of Patent: Feb. 22, 2022

(54) CHAIR WITH RETURN FORCE MECHANISM

(71) Applicant: KOKUYO CO., LTD., Osaka (JP)

(72) Inventors: Toshiki Yajima, Osaka (JP); Takao Sugano, Osaka (JP)

(73) Assignee: KOKUYO CO., LTD., Osaka (JP)

( * ) Notice: Subject to any disclaimer, the term of this patent is extended or adjusted under 35 U.S.C. 154(b) by 225 days.

(21) Appl. No.: 16/464,384

(22) PCT Filed: Dec. 21, 2016

(86) PCT No.: PCT/JP2016/088208
§ 371 (c)(1),
(2) Date: May 28, 2019

(87) PCT Pub. No.: WO2018/116426
PCT Pub. Date: Jun. 28, 2018

(65) Prior Publication Data
US 2021/0112988 A1 Apr. 22, 2021

(51) Int. Cl.
*A47C 1/032* (2006.01)
*A47C 3/026* (2006.01)
(Continued)

(52) U.S. Cl.
CPC ..... *A47C 7/566* (2013.01); *A47C 1/024* (2013.01); *A47C 1/0244* (2013.01);
(Continued)

(58) Field of Classification Search
USPC ..... 297/302.1–302.4, 314, 325
See application file for complete search history.

(56) References Cited

U.S. PATENT DOCUMENTS 455,866 A * 7/1891 Quinlan ..... A47C 3/026 248/578
1,961,530 A * 6/1934 Spanenberg ..... B60N 2/39 248/577
(Continued)

FOREIGN PATENT DOCUMENTS

CA 3009482 A1 * 8/2017 ..... A47C 1/024
CA 3044190 A1 * 6/2018 ..... A47C 7/443
(Continued)

OTHER PUBLICATIONS 20 page PDF of machine translation of DE 10 2010 016 989A1 cited as an X reference in a corresponding EP search report. (Year: 2011).*
(Continued)

*Primary Examiner* — Robert Canfield
(74) *Attorney, Agent, or Firm* — Westerman, Hattori, Daniels & Adrian, LLP

(57) ABSTRACT

A chair according to the present invention has a reference position P located midway in a front-back direction in a movable range of a seat 2. The chair includes a return force generation mechanism 4 configured to generate a return force in a direction to return the seat 2 moved from the reference position P at least in the front-back direction to the reference position P. The return force generation mechanism 4 includes an elastic member 40 configured to increase the return force in the direction to return the seat to the reference position P as the amount of movement of the seat from the reference position P increases.

12 Claims, 13 Drawing Sheets

(51) Int. Cl.

| | |
|---|---|
| ***A47C 7/56*** | (2006.01) |
| ***A47C 1/024*** | (2006.01) |
| ***A47C 3/025*** | (2006.01) |
| ***A47C 7/00*** | (2006.01) |

(52) U.S. Cl.
CPC ..... *A47C 1/03266* (2013.01); *A47C 1/03272* (2013.01); *A47C 1/03283* (2013.01); *A47C 3/025* (2013.01); *A47C 3/026* (2013.01); *A47C 7/004* (2013.01); *A47C 7/563* (2013.01)

(56) References Cited

U.S. PATENT DOCUMENTS

| | | | | | |
|---|---|---|---|---|---|
| 2,619,153 | A * | 11/1952 | Van Osselen | A47C 3/026 | 297/303.4 |
| 2,681,686 | A * | 6/1954 | Sheron | B60N 2/39 | 248/582 |
| 3,024,067 | A * | 3/1962 | Brandoli | B60N 2/231 | 297/362.13 |
| 3,278,228 | A * | 10/1966 | Doerner | A47C 3/026 | 297/303.5 |
| 4,143,910 | A * | 3/1979 | Getters | A47C 1/03283 | 297/300.3 |
| 4,200,332 | A * | 4/1980 | Brauning | A47C 1/03255 | 248/619 |
| 4,364,605 | A * | 12/1982 | Meiller | A47C 7/446 | 297/300.3 |
| 4,431,157 | A * | 2/1984 | Arild | A47C 7/4454 | 248/583 |
| 4,521,053 | A * | 6/1985 | de Boer | A47C 1/022 | 297/291 |
| 4,575,151 | A * | 3/1986 | Edstrom | A47C 7/445 | 297/303.3 |
| 4,589,697 | A * | 5/1986 | Bauer | A47C 1/022 | 297/301.2 |
| 4,605,334 | A * | 8/1986 | Kalvatn | A47C 9/002 | 403/291 |
| 4,682,814 | A * | 7/1987 | Hansen | A47C 1/03255 | 297/300.3 |
| 4,906,045 | A | 3/1990 | Hofman | | |
| 4,962,962 | A * | 10/1990 | Machate | A47C 31/126 | 297/300.5 |
| 4,966,411 | A * | 10/1990 | Katagiri | A47C 1/03294 | 297/300.7 |
| 5,160,184 | A * | 11/1992 | Faiks | A47C 3/026 | 267/131 |
| 5,536,067 | A * | 7/1996 | Pinto | A47C 7/024 | 297/215.15 |
| 5,573,303 | A * | 11/1996 | Doerner | A47C 1/03255 | 297/300.5 |
| 6,234,573 | B1 * | 5/2001 | Roder | A47C 1/03238 | 297/300.5 |
| 6,238,000 | B1 * | 5/2001 | Hallmark | A47C 1/03238 | 297/300.5 |
| 6,935,689 | B2 * | 8/2005 | Horiki | A47C 1/03266 | 297/300.5 |
| 7,637,570 | B2 * | 12/2009 | Becker | A47C 7/28 | 297/314 |
| 8,272,692 | B1 * | 9/2012 | Epperson | A47C 1/03283 | 297/300.3 |
| 8,662,586 | B2 * | 3/2014 | Serber | A47C 9/002 | 297/316 |
| 10,058,180 | B2 * | 8/2018 | Desanta | A47C 1/032 | |
| 10,272,282 | B2 * | 4/2019 | Harlow | A47C 7/441 | |
| 10,806,260 | B2 * | 10/2020 | Sugano | A47C 1/03294 | |
| 10,820,704 | B2 * | 11/2020 | Sugano | A47C 3/18 | |
| 10,842,276 | B2 * | 11/2020 | Sugano | A47C 7/14 | |
| 10,881,208 | B2 * | 1/2021 | Yajima | A47C 3/026 | |
| 10,945,529 | B2 * | 3/2021 | O'Boyle | A47C 7/4454 | |
| 2008/0088163 | A1 * | 4/2008 | Sander | A47C 1/03255 | 297/300.4 |
| 2009/0261642 | A1 * | 10/2009 | Dickie | A47C 9/002 | 297/314 |
| 2010/0117427 | A1 | 5/2010 | Fukuyama et al. | | |
| 2012/0175929 | A1 * | 7/2012 | Kumazawa | A47C 1/0244 | 297/311 |
| 2018/0153306 | A1 | 6/2018 | Schmitz et al. | | |
| 2020/0085195 | A1 * | 3/2020 | Shibamoto | A47C 3/0255 | |
| 2020/0315355 | A1 * | 10/2020 | Shibamoto | A47C 7/443 | |

FOREIGN PATENT DOCUMENTS

| | | | | |
|---|---|---|---|---|
| DE | 2437059 | A1 * | 2/1975 | A47C 31/02 |
| DE | 2514590 | A * | 10/1975 | A47C 3/026 |
| DE | 102010016989 | A1 | 11/2011 | |
| DE | 102016104644 | A1 | 9/2016 | |
| EP | 0 164 266 | A3 | 4/1987 | |
| EP | 0298928 | A2 * | 1/1989 | A47C 7/443 |
| EP | 2387913 | A1 | 11/2011 | |
| EP | 3195761 | A1 * | 7/2017 | A47C 3/026 |
| JP | 58-100656 | U | 7/1983 | |
| JP | 61-45707 | A | 3/1986 | |
| JP | 2007-37600 | A | 2/2007 | |
| JP | 2008-167908 | A | 7/2008 | |
| JP | 2012-217845 | A * | 11/2012 | |
| JP | 2019037383 | A * | 3/2019 | |
| WO | 2011/144660 | A1 | 11/2011 | |
| WO | WO-2018116426 | A1 * | 6/2018 | |
| WO | WO-2018173085 | A1 * | 9/2018 | |

OTHER PUBLICATIONS

Office Action dated Jun. 23, 2020, issued in counterpart JP Application No. 2018-557469, with English Translation (11 pages).
Extended (Supplementary) European Search Report dated Jul. 21, 2020, issued in counterpart EP Application No. 16924780.6. (7 pages).
International Search Report dated Apr. 4, 2017, issued in counterpart International Application No. PCT/JP2016/088208 (2 pages).
Office Action dated Feb. 2, 2021, issued in counterpart CA Application No. 3044190. (5 pages).
Office Action dated Mar. 30, 2021, issued in counterpart JP Application No. 2018-557469, with English translation. (5 pages).
Office Action dated Oct. 14, 2021, issued in counterpart CA Application No. 3,044,190. (3 pages).

* cited by examiner

CHAIR WITH RETURN FORCE MECHANISM

TECHNICAL FIELD

The present invention relates to a chair applicable in an office or the like.

BACKGROUND ART

Many chairs such as chairs intended for a sitting person to maintain a comfortable sitting posture for a long time in an office, at home, or the like have been conventionally provided (for example, see Patent Document 1). Each of the chairs is configured to tilt a seat or a backrest in accordance with backward tilting of a sitting person such that a sitting person can comfortably move while doing work. Also, the chair is configured to fix the seat or the backrest in position such that the sitting person can take a desirable posture, and the chair is designed so that a spring reaction force can be appropriately set.

CITATION LIST

Patent Literature

Patent Document 1: Japanese Unexamined Patent Application Publication No. S61-45707

SUMMARY OF THE INVENTION

Problem to be Solved by the Invention

However, some of conventionally typical chairs have been known as chairs each provided with integral seat and backrest or chairs each provided with so-called synchronized locking mechanism. Each of the chairs is typically configured such that an elastic member for applying a repelling force of a backrest is utilized to return a seat from a backward moved position to a forward normal position. Meanwhile, in recent years, some chairs have been considered as so-called swingable chairs such that a seat of each of the chairs is movable not only backward but also forward to enhance the efficiency of deskwork or to improve an appropriate posture. In a case where it is intended to realize such a chair, a conventional reaction force mechanism is utilized and therefore even when the seat is moved to a front end, the reaction force mechanism of a backrest acts. Consequently, the chair swings forward or backward from a reference position and the function to return the chair back to the reference position may not be realized. As a result, it is desired to create some of new structures for realizing such a function.

The present invention is made in view of the problem above and is intended to newly realize a chair configured such that even when being moved from a reference position forward or backward, a seat can stop in an appropriate position or return back to the initial reference position.

Means for Solving the Problem

The present invention adopts the following means in order to achieve such an object. In other words, a chair according to the present invention has a reference position located midway in a front-back direction in a movable range of a seat, and the chair includes a return force generation mechanism configured to generate a return force in a direction to return the seat moved from the reference position at least in the front-back direction to the reference position. The return force generation mechanism includes an elastic member configured to increase the return force in the direction to return the seat to the reference position as an amount of movement of the seat from the reference position increases.

With such a configuration, the chair is different from a conventional chair movable only backward in that the chair according to the present invention is movable in the opposite direction; therefore, increasing a posture changeable range. Further, at the time of either forward or backward movement of the seat, the center of the gravity of the seat is likely to shift downward as the seat moves. In this case, the force to shift upward the center of gravity that has been shifted downward is needed to return the seat to the reference position. Accordingly, the return force is set so as to increase in accordance with the amount of either forward or backward movement of the seat from the reference positions. With such a configuration, the seat can stop at an appropriate position in a balanced manner, or the assist force for allowing a sitting person to change his/her posture can be obtained from the return force generation mechanism. Consequently, according to the chair of the present invention, the sitting person can be appropriately seated not only in a normal sitting posture in a state where the chair is located at or adjacent to the reference position or in a backward tilted posture when the seat is moved backward, but also in a forward tilted posture when the seat is moved forward. As a result, the chair allowing the sitting person not to easily get tired even when being seated for a long time can be realized.

In that case, it is desirable that the reference position may be located midway in the front-back direction in the movable range and may be defined as a position when a person is not seated; and the seat may be stationary on that the elastic force in the front-back direction is zero or balanced is located at the reference position.

If the elastic force is zero, the smooth behavior of the seat located from a position adjacent to the reference position can be effectively realized. In addition, if the elastic force is balanced, an initial reaction force can be appropriately applied at the time of the forward or backward movement of the seat from the reference position.

Further, the return force generation mechanism is configured to make an elastic biasing force variably adjustable. Therefore, even if the force required to return the seat to the reference position increases in accordance with the increase of the physical size of a sitting person, the return force can be adjusted in accordance with the physical size or preference of the sitting person.

Furthermore, even for the same sitting person, the way that the center of gravity shifts downward at the time of the forward movement of the seat differs from the way that the center of gravity shifts downward at the time of the backward movement of the seat. Consequently, the force required to return the seat at the time of the forward movement differs from the force required to return the seat at the time of the backward movement. Therefore, if the elastic member includes an elastic member for applying an elastic biasing force toward the reference position when the seat is located forward of the reference position, and an elastic member for applying an elastic biasing force toward the reference position when the seat is located backward of the reference position, respectively, and the elastic biasing forces are separately set, an appropriate usage environment can be offered suitably with each of directions.

Moreover, the chair includes a forward elastic member configured to apply an elastic biasing force in the front-back direction of the seat only when the seat is located forward of the reference position, and a backward elastic member configured to apply an elastic biasing force in the front-back direction of the seat only when the seat is located backward of the reference position. In addition, if repelling force properties of each of the elastic members are variably adjustable, the elastic force at the time of the forward movement of the seat and the elastic force at the time of the backward movement of the seat can be adjusted to have different strengths from each other without moving the reference position.

On the other hand, if the elastic member includes a single elastic member for applying an elastic biasing force toward the reference position when the seat is located forward of the reference position, and a single elastic member for applying an elastic biasing force toward the reference position when the seat is located backward of the reference position, the number of components of the elastic member can be reduced, and in addition, the basic function of the present invention can be simply configured.

The mode to change repelling force properties may include a configuration where an initial displacement of the elastic member is changed to make an elastic biasing force variably adjustable, or a configuration where an initial position of the elastic member is changed to change the displacement of the elastic member due to the positional change of the seat to make repelling force properties of the elastic member variably adjustable.

In order to adjust the reference position with the use of the above configuration, it is desirable that the initial displacement or the initial position of the elastic member may be changed so as to shift the reference position.

Moreover, according to the present invention, more preferably, the seat is supported by a front-back movement mechanism and a left-right movement mechanism that are separate members, and the seat is configured to be movable in the front-back direction and in a left-right direction. In addition, the chair includes an independent return force generation mechanism in left-right direction.

With such a configuration, the seat is independently movable not only in the front-back direction and but also in the left-right direction. In addition, the independent return force generation mechanism for left-right direction is provided. Therefore, it is possible to realize that the seat can be smoothly moved and more various usages of the seat can be offered.

In this case, the return force generation mechanism for left-right direction is configured such that the center of gravity of the seat shifts upward in accordance with the movement of the seat from the reference position. Accordingly, since the seat is less likely to largely or frequently move in the left-right direction compared with in the front-back direction, an appropriate return force to return the seat to the reference position can be obtained by the use of the return due to gravity and the structure is simply obtained. Therefore, cost reduction can be obtained. Here, the return due to gravity is as follows. When the seat is located at the reference position, the center of gravity of the seat is located at the lowest position. When the seat is moved right or left, the center of gravity is shifted upward. And an appropriate return force can be automatically obtained regardless of the weight of a sitting person.

Effect of the Invention

The present invention described above can newly provide a chair configured such that even when being moved from a reference position forward or backward, a seat can stop in an appropriate position or return back to the initial reference position.

BRIEF DESCRIPTION OF THE DRAWINGS

FIGS. 5A to 5B3 are a drawing illustrating a return force generation mechanism according to the first embodiment of the present invention.

MODE FOR CARRYING OUT THE INVENTION

Herein, a first embodiment of the present invention will be described with reference to FIGS. 1 and 5A to 5B3.

Figure 1:
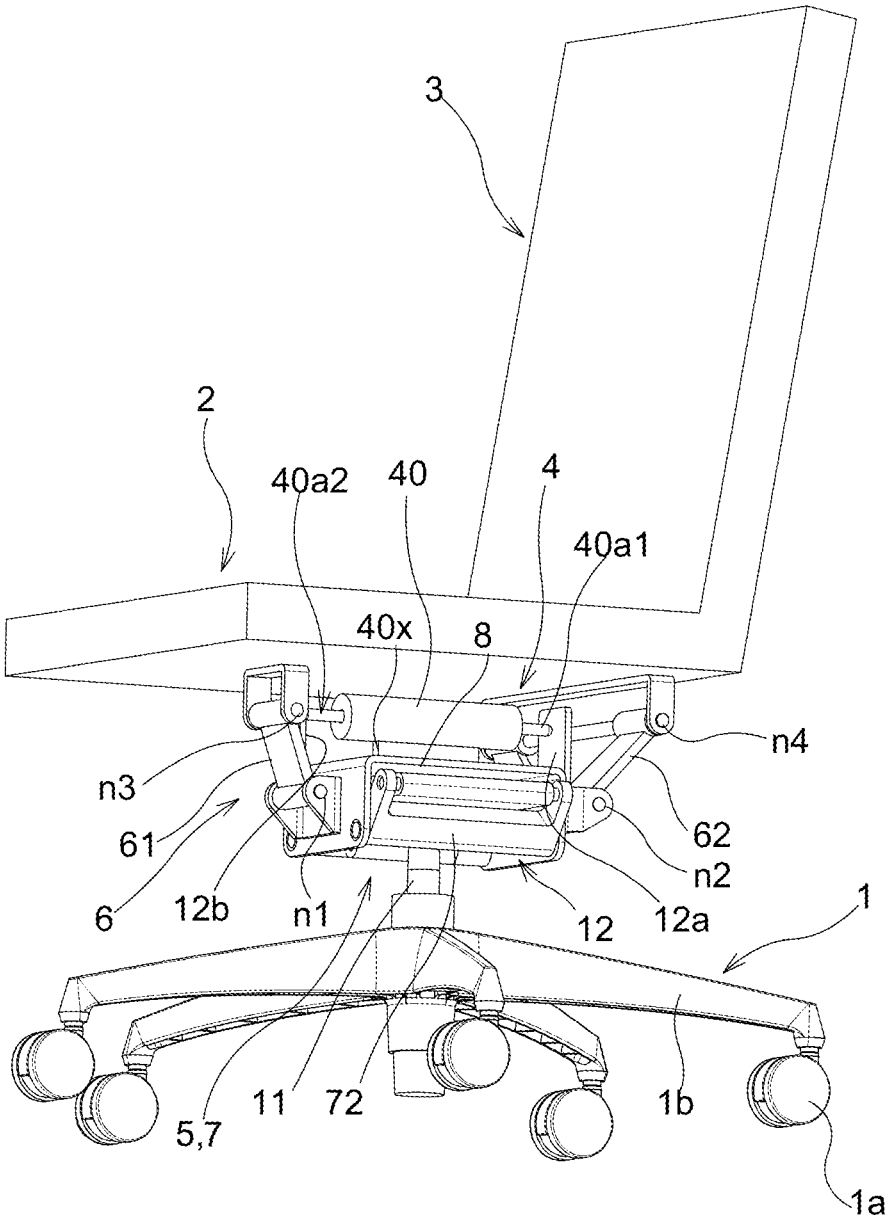
FIG. 1 is a perspective view of a chair according to a first embodiment of the present invention.
Figure 2:
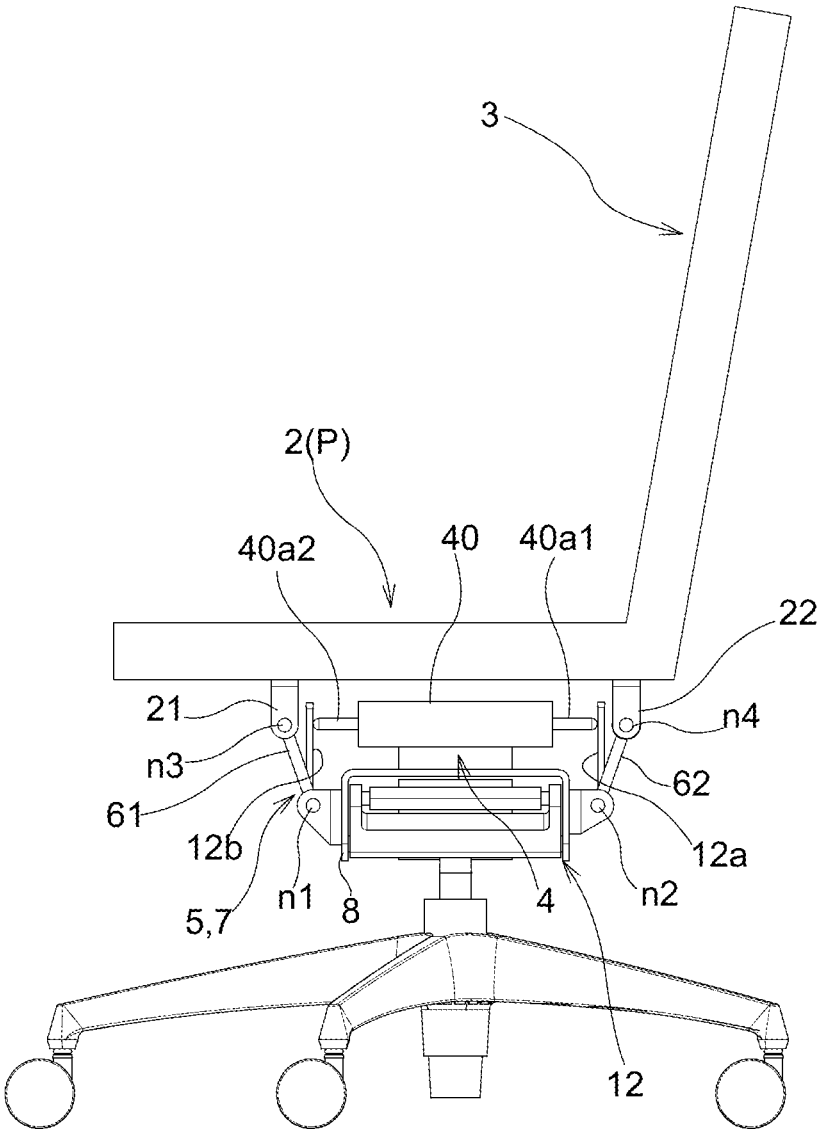
FIG. 2 is a right-side view of the chair according to the first embodiment of the present invention.
Figure 3:
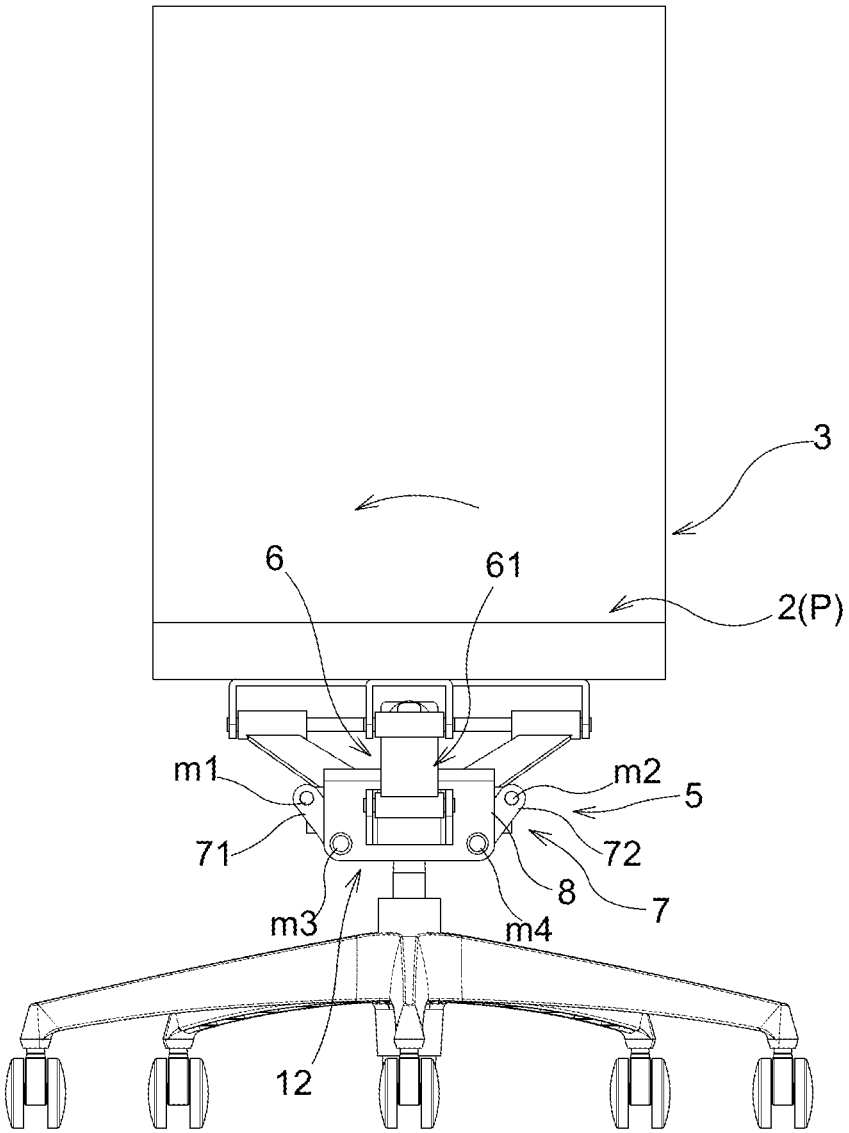
FIG. 3 is a front view of the chair according to the first embodiment of the present invention.
Figure 4:
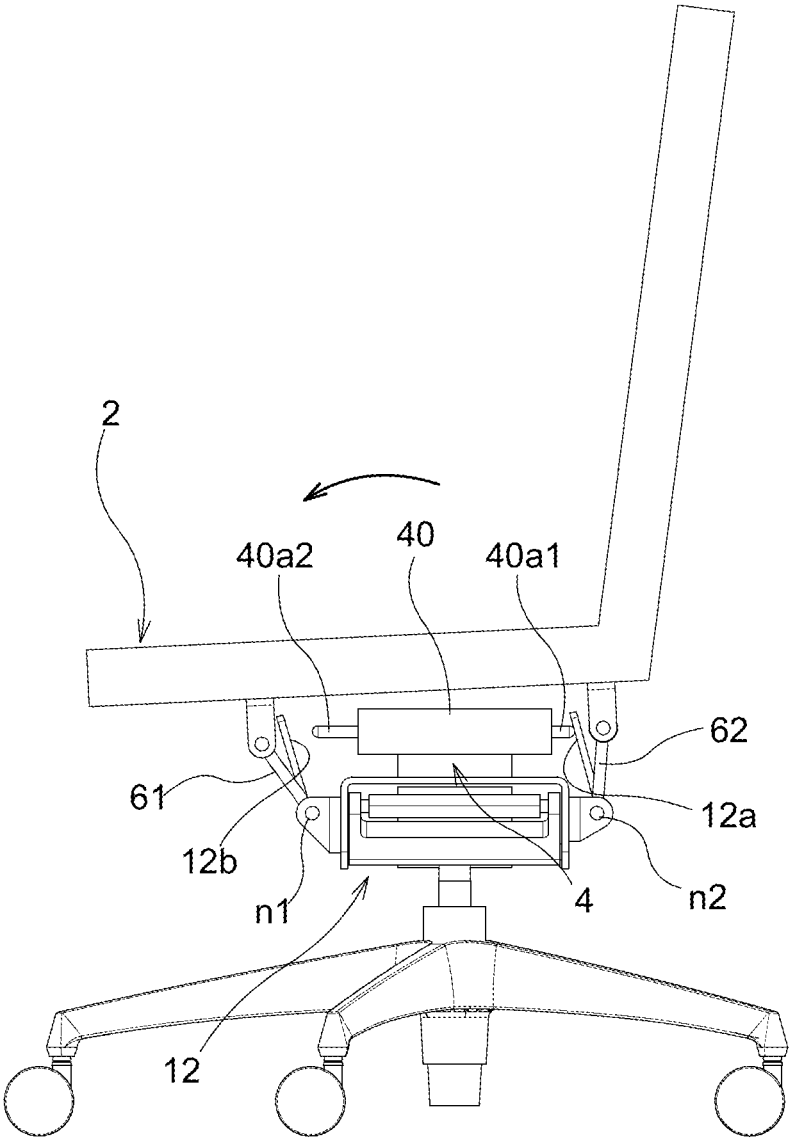
FIG. 4 is a right-side view illustrating a state where a seat according to the first embodiment of the present invention is moved forward.

FIGS. 1 to 3 are respectively perspective, right-side, and front views of a chair according to the first embodiment. FIG. 4 is an explanatory drawing of movement of the chair according to the first embodiment. The chair is configured such that a seat 2 integrally formed with a backrest 3 is rotatably supported by a leg support pole 11 protruding from a leg 1. The position of the seat 2 when no one is seated is defined as a reference position P. The chair includes a function to move and return the seat 2 with respect to the reference position P.

Specifically, the leg 1 of the chair includes leg blades 1*b* having ends to which casters 1*a* are respectively attached. The leg support pole 11 is attached to a center hole of the leg blades 1*b*. A support base 12 adapted to support the seat 2 is rotatably attached to an upper end of the leg support pole 11.

The seat 2 is supported by the support base 12 to be movable forward or backward by a front-back movement mechanism 6 and to be movable right or left by a left-right movement mechanism 7.

The front-back movement mechanism 6 includes a front link member 61 having a lower end pivotally supported around a left-right shaft n1 by a casing 8, and a back link member 62 having a lower end pivotally supported around a left-right shaft n2 by the casing 8. When the seat 2 is located at the reference position P, an upper end of the front link member 61 is attached in a forward tilted posture to a bracket 21 at a front end of the seat 2 to be pivotal around a left-right shaft n3 and an upper end of the back link member 62 is attached in a backward tilted posture to a bracket 22 at a back end of the seat 2 to be pivotal around a left-right shaft n4. In other words, when the seat 2 is moved forward from the reference position P, the front link member 61 is brought into a further forward tilted posture and the back link member 62 is brought into an upright posture. Thus, the seat 2 is tilted forward. Meanwhile, when the seat 2 is moved backward, the back link member 62 is brought into a further backward tilted posture and the front link member 61 is brought into an upright posture. Thus, the seat 2 is tilted backward.

Also, the left-right movement mechanism 7 includes a left link member 71 and a right link member 72. Upper ends of the respective link members 71, 72 are pivotally supported around front-back shafts m1, m2 by appropriate portions of the support base 12. When the seat 2 is located at the reference position P, lower ends of the respective link members 71, 72 are pivotally attached to the casing 8 around front-back shafts m3, m4 in a state where the link members 71, 72 are tilted with the lower ends located near each other; thereby the casing 8 is suspended. The casing 8 includes a hollow part opened downward, and the support base 12 is arranged in the hollow part without interfering with the hollow part.

Figure 7:
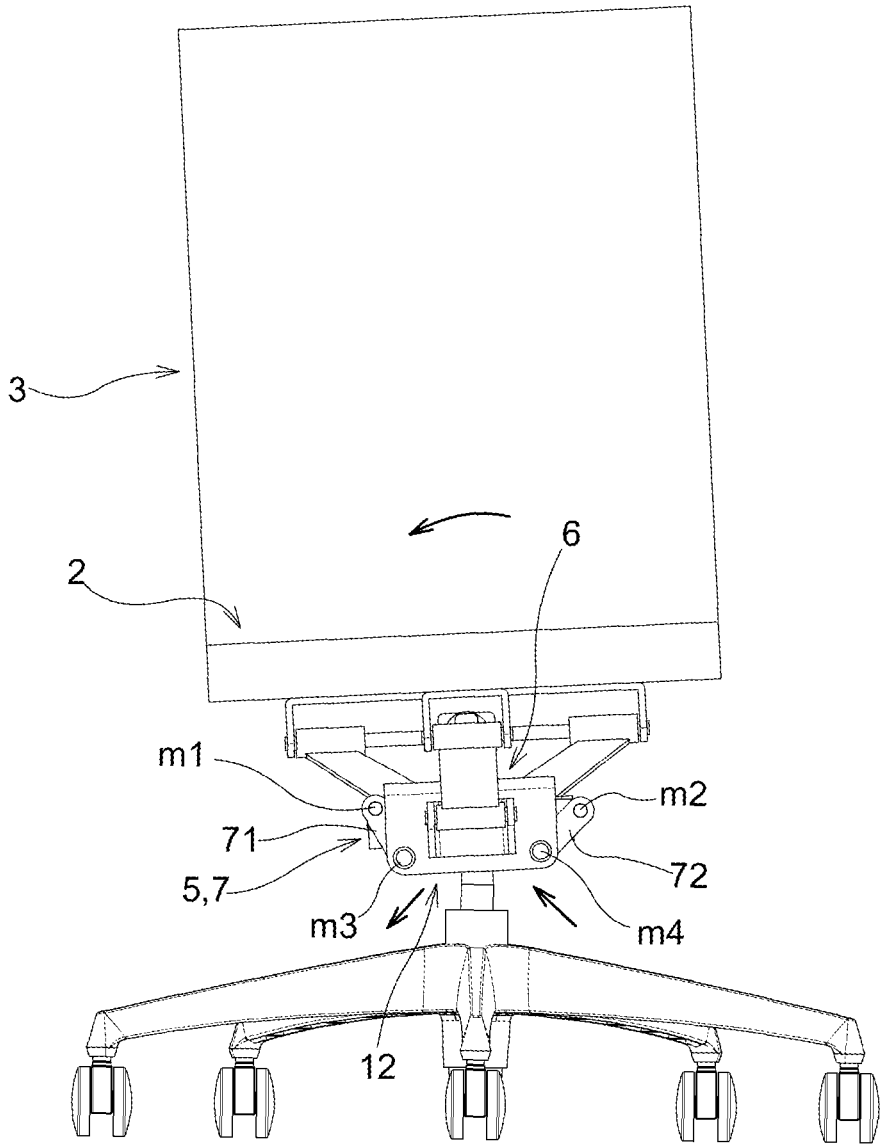
FIG. 7 is a drawing illustrating a left-right movement mechanism according to the first embodiment of the present invention.
Figure 8:
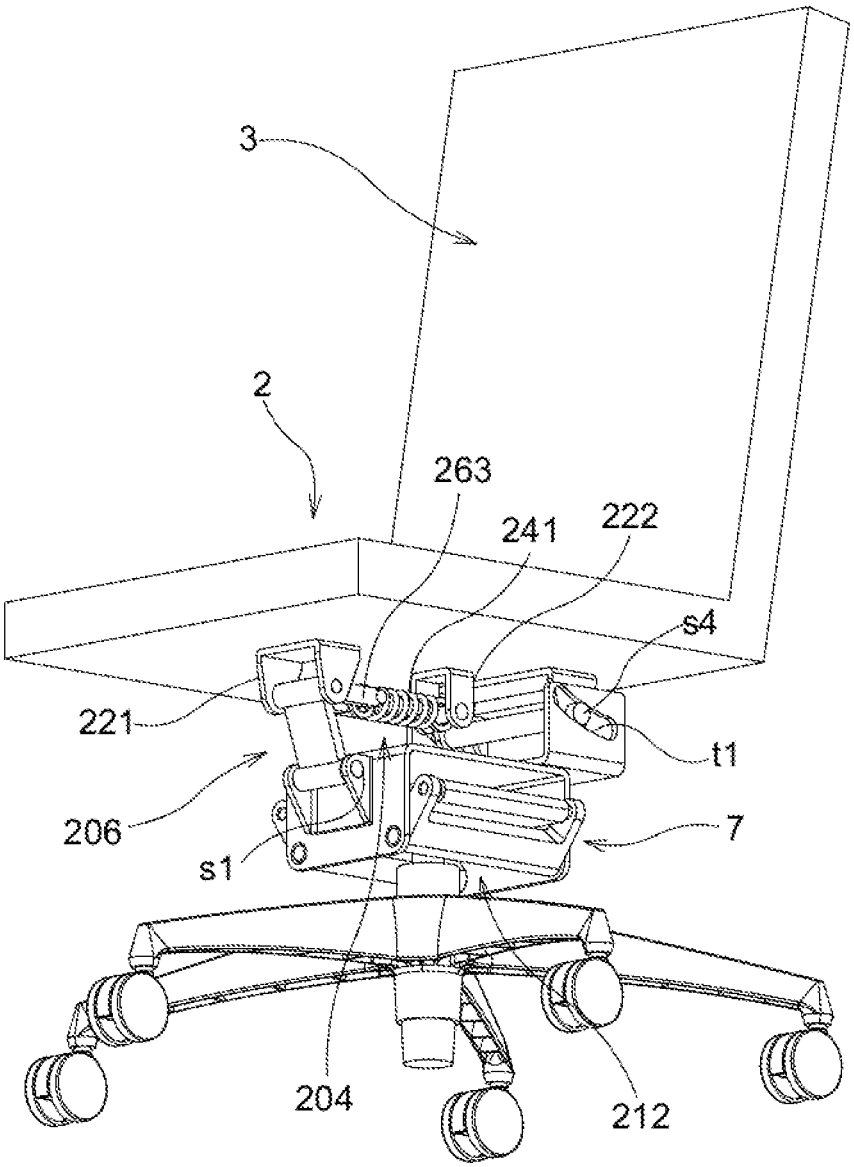
FIG. 8 is a perspective view of the chair according to a second embodiment of the present invention.
Figure 9:
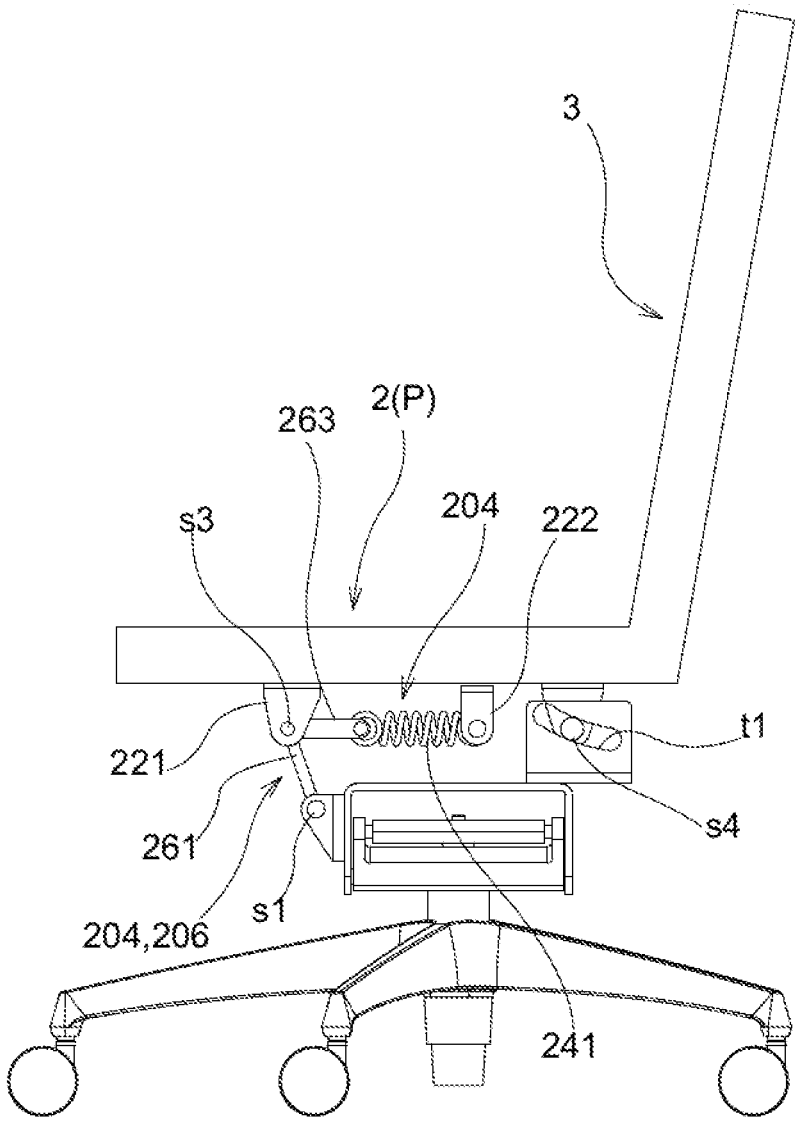
FIG. 9 is a right-side view of the chair according to the second embodiment of the present invention.
Figure 10:
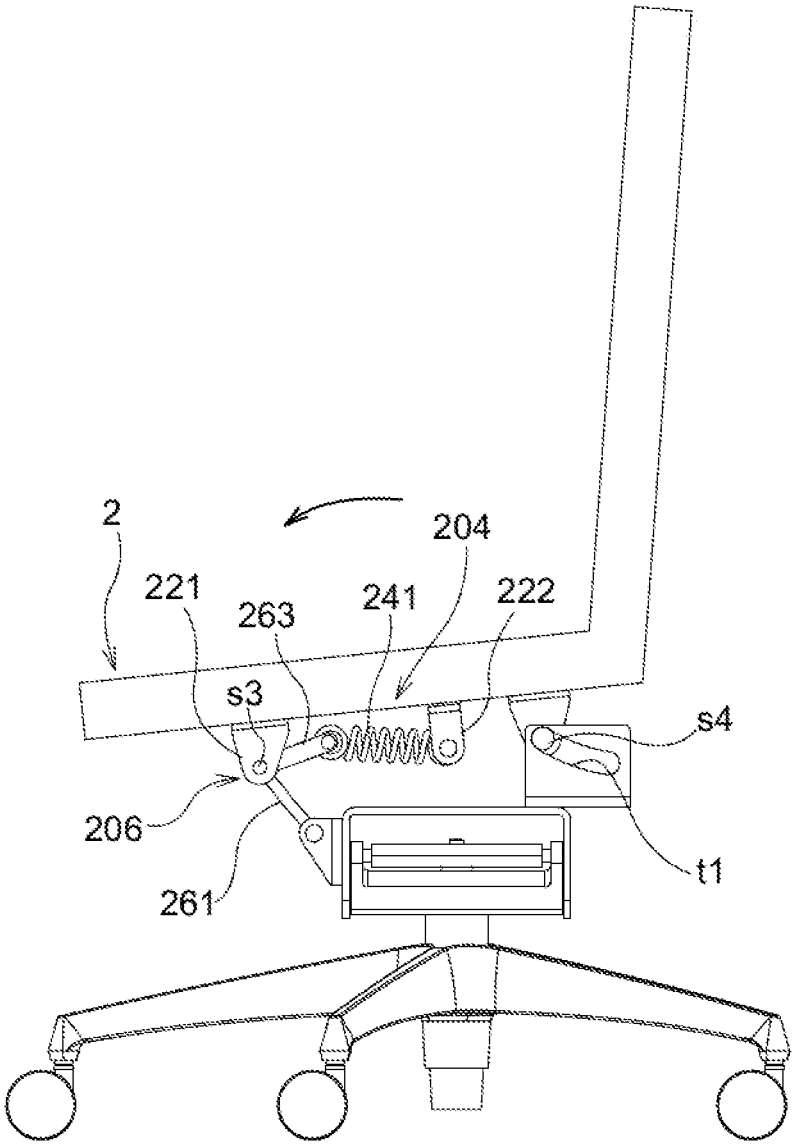
FIG. 10 is a right-side view illustrating a state where the seat according to the second embodiment of the present invention is moved forward.
Figure 11:
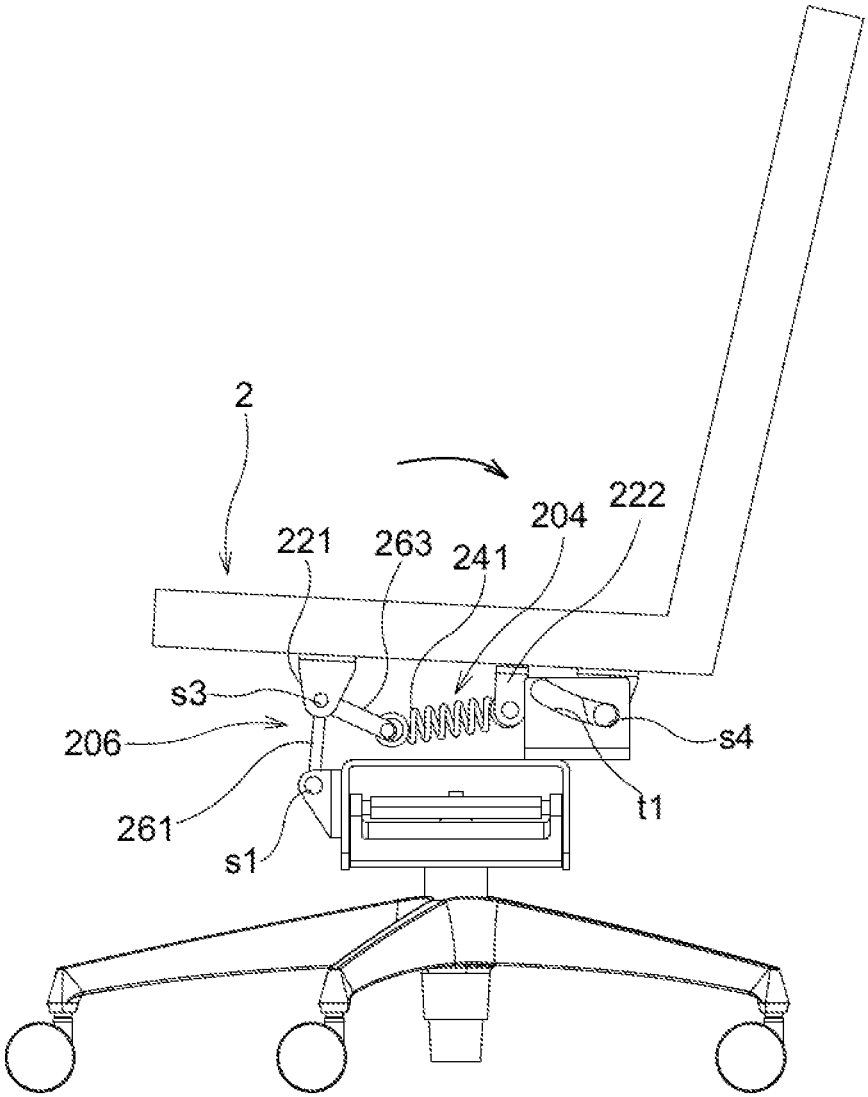
FIG. 11 is a right-side view illustrating a state where the seat according to the second embodiment of the present invention is moved backward.
Figure 12:
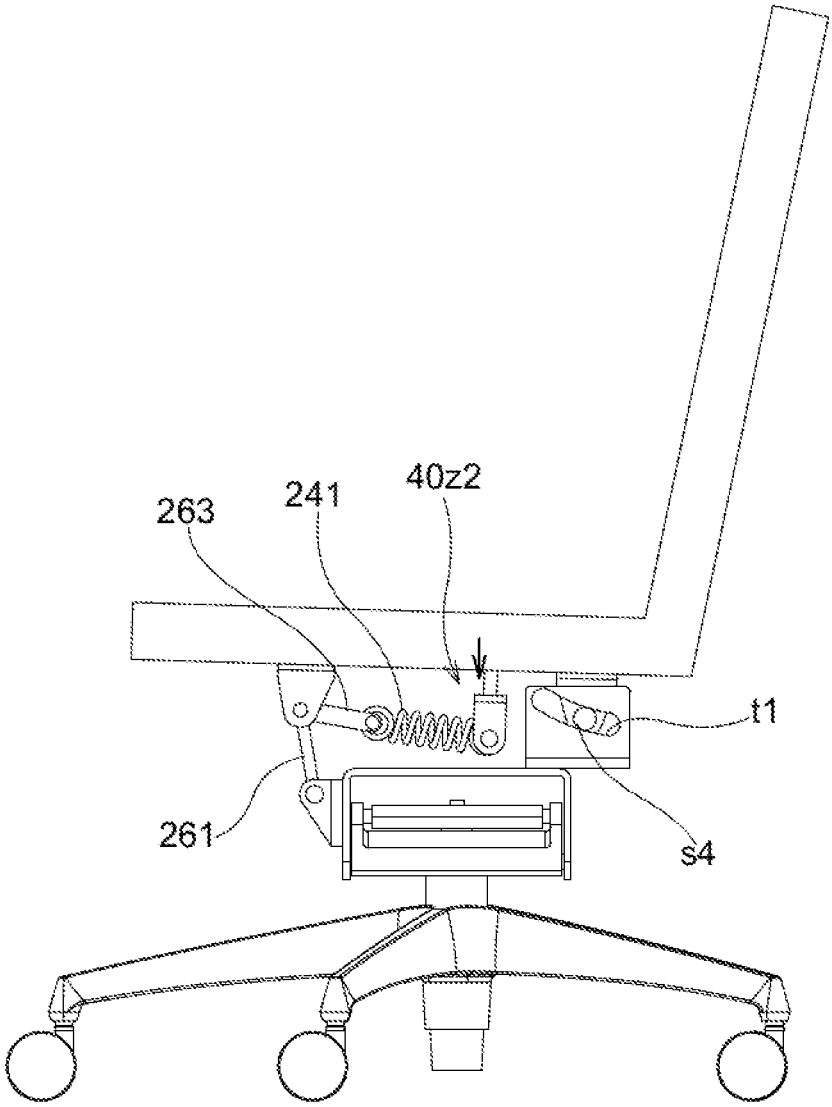
FIG. 12 is a drawing illustrating a state where the reference position of the seat is shifted backward by a change of the position of the elastic member in the second embodiment of the present invention.

That is, when the seat 2 is moved left with respect to the support base 12, the inclination of the left link member 71 decreases to come close to a vertical posture and the inclination of the right link member 72 increases to come close to a horizontal posture. As a result, the casing 8 is tilted left in front view as illustrated in FIG. 7. Meanwhile, when the seat 2 is moved right with respect to the support base 12, the inclination of the right link member 72 decreases to come close to a vertical posture and the inclination of the left link member 71 increases to come close to a horizontal posture. As a result, the casing 8 moves right in front view, i.e., moves in the opposite direction illustrated in FIG. 3.

In other words, the seat 2 is moved forward or backward with respect to the support base 12 via the casing 8 swingable right or left, therefore being configured to be movable independently in each of front-back or left-right directions. As a result, multiple behaviors or movements of the seat 2 can be realized.

In addition, the chair includes a first return force generation mechanism 4 illustrated in FIGS. 2 and 5A to 5B3 and a second return force generation mechanism 5 illustrated in FIG. 3. Each of the return force generation mechanisms 4, 5 are configured to generate a return force in a direction to return the seat moved in the front-back or left-right direction to the reference position P, and is designed to increase the return force for returning the seat to the reference position P as the amount of movement of the seat from the reference position P increases.

Figure 5A:
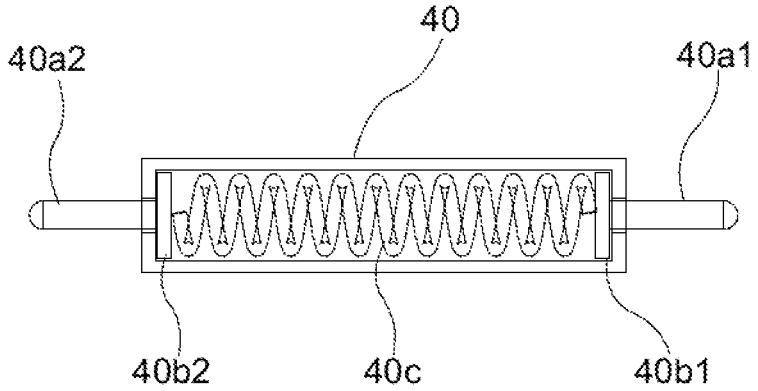
Figure 5A:
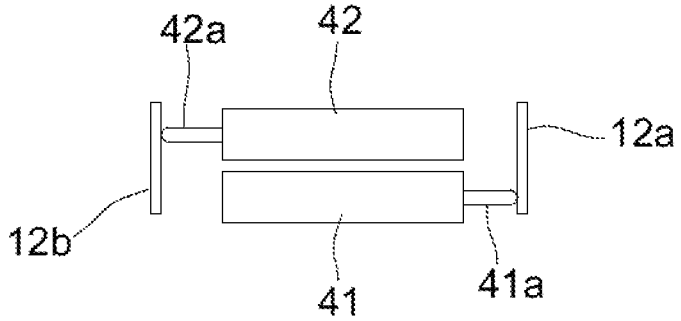
Figure 5A:
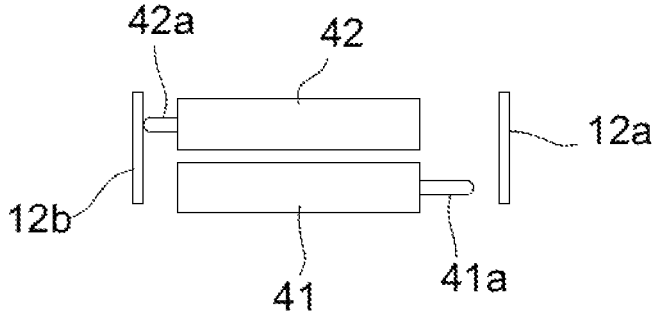
Figure 5A:
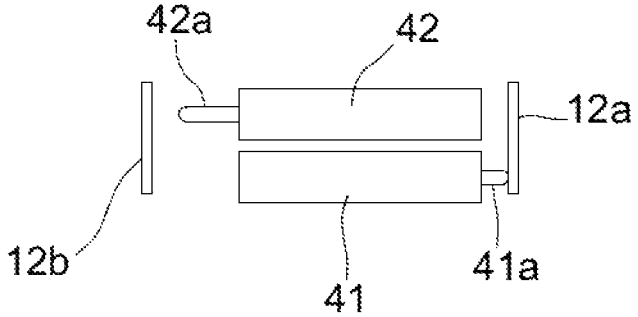

The first return force generation mechanism 4 includes a cylinder 40 as an elastic member supported through a support portion 40*x* by the casing 8, and rods 40*a*1, 40*a*2 respectively protruding backward and forward from opposite ends of the cylinder 40. The first return force generation mechanism 4 is configured to store an elastic repelling force when each of the rods 40*a*1, 40*a*2 is retracted in the cylinder 40. Specifically, as illustrated in FIG. 5A, the rods 40*a*1, 40*a*2 are respectively connected to retainers 40*b*1, 40*b*2 in the cylinder 40. A compression spring 40*c* is interposed between the retainers 40*b*1, 40*b*2. Each of the rods 40*a*1, 40*a*2 is independently retractable in the cylinder 40 while compressing the spring 40*c*. In addition, the cylinder 40 is fixed to the support base 12.

Also, contact plates 12*a*, 12*b* are provided at positions opposite to ends of respective rods 41*a*, 42*a*. The contact plates 12*a*, 12*b* are configured to be integrally pivotal with the backlink member 62 and the front link member 61, respectively. Thus, the seat 2 is moved forward as illustrated from a state of FIG. 2 to a state of FIG. 4. At this time, in accordance with a standing movement of the backlink member 62, the contact plate 12*a* integral with the backlink member 62 compresses the rod 40*a*1 while pushing the rod 40*a*1; therefore, the front link member 61 tilts forward to separate from the rod 40*a*2. Consequently, the spring 40*c* is compressed to store a backward return force. When the seat 2 is moved backward, a reversed action to the above-mentioned forward movement allows the contact plate 12*b* integral with the front link member 61 to compress the rod 40*a*2; therefore, the spring 40*c* is compressed to store a forward return force. The spring 40*c* may be configured to have a natural length in a state where the seat 2 is located at the reference position P. Alternatively, the spring 40*c* may be initially compressed to be set in a condition that the repelling force is balanced when the seat 2 is located at the reference position P.

In such a case, the first return force generation mechanism 4 may be configured by a pair of cylinders 41, 42 as elastic members as illustrated in FIGS. 5A to 5B3. In this case, an elastic repelling force is stored when each of the rods 41*a*, 42*a* protruding from the respective cylinders 41, 42 is retracted therein. The cylinders 41, 42 are arranged to be movable with the seat 2 in the front-back direction. The cylinder 41 is configured such that the rod 41*a* protrudes backward and faces to the contact plate 12*a*, and the cylinder 42 is configured such that the rod 42*a* protrudes forward and faces to the contact plate 12*b*. Thus, when the seat 2 is moved forward, the rod 41*a* of the one cylinder 41 is compressed as illustrated in FIG. 5B 3 to store a backward return force. Meanwhile, when the seat 2 is moved backward, the rod 42*a* of the other cylinder 42 is compressed as illustrated in FIG. 5B 2 to store a forward returning force. In such a case, the repelling force may not be stored or may be balanced when the seat is located at the reference position in FIG. 5B 1.

With such a configuration, the compression properties of the both cylinders 41, 42 may be changeable. In the first embodiment, a spring coefficient of the cylinder 42 to be compressed at the time of the forward movement of the seat 2 is appropriately set to be smaller than a spring coefficient of the cylinder 41 to be compressed at the time of the backward movement of the seat 2.

Further, a pair of link members 71, 72 configuring the left-right movement mechanism 7 illustrated in FIG. 3 also serves the second return force generation mechanism 5 configured to generate a return force in a direction to return the seat 2 moved from the reference position P in the left-right direction to the reference position P. That is, the pair of link members 71, 72 is configured to hold an object to be suspended in the lowest position by gravity, and the position is defined as a stable position. Even when the object is moved from the stable position either right or left, the center of gravity of the seat shifts upward while a movement of the tip side is inclining downward in accordance with the amount of movement. Accordingly, a return force is generated and a return force at the reference position P becomes zero.

In the first embodiment, the reference position P is located midway in a front-back movable range. However, since the chair is configured such that the seat is integrally formed with the backrest, it is effective that for example, by application of an appropriate stopper, a backward movable distance of the seat 2 and the backrest 3 from the reference position P is set to be larger than a forward movable distance of the seat 2 and the backrest 3 from the reference position P.

Figure 6:
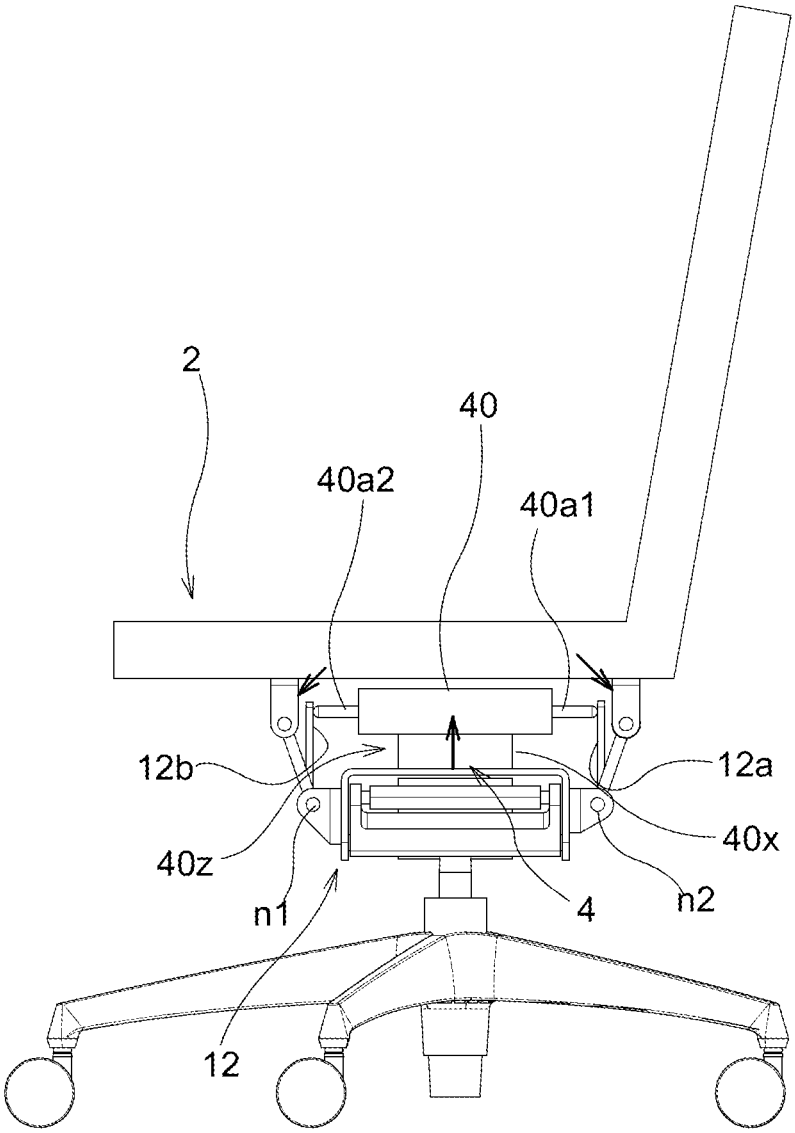
FIG. 6 is a drawing illustrating a state where a return force is increased by a change of the position of an elastic member in the first embodiment of the present invention.

Additionally, as illustrated in FIG. 6, a return force adjustment mechanism 40*z* is provided in the first embodiment. The return force adjustment mechanism 40*z* is configured such that an initial position of the cylinder 40 as the elastic member is changed to change the displacement of the cylinder 40 due to the positional change of the seat 2. The return force adjustment mechanism 40*z* is configured to move up/down the support portion 40*x* supporting the cylinder 40. Accordingly, a distance from the left-right shaft n1 to the contact plate 12*a* to be brought into contact with the rod 40*a*1 and a distance from the left-right shaft n2 to the contact plate 12*b* to be brought into contact with the rod 40*a*2 vary. Therefore, according to the principle of leverage, for the same amount of movement of the seat 2, the displacement of the cylinder 40 increases as the cylinder 40 is moved upward. Consequently, a reaction force increases. On the other hand, the displacement of the cylinder 40 decreases as the cylinder 40 is moved downward; therefore, a reaction force decreases.

As described above, the chair according to the first embodiment includes the return force generation mechanism 4 configured to generate a return force in a direction to return the seat moved from the reference position P at least in the front-back direction to the reference position P. The return force generation mechanism 4 includes the cylinder 40 as the elastic member configured to increase the return force for returning the seat to the reference position P as an amount of movement of the seat from the reference position P increases.

Such a chair is different from a conventional chair movable only backward in that the chair according to the first embodiment is movable in the opposite direction, i.e., movable forward; therefore, increasing a posture changeable range. Further, at the time of either forward or backward movement of the seat 2, the center of the gravity of the seat is likely to shift downward as the seat moves. In this case, the force to shift upward the center of gravity that has been shifted downward is needed to return the seat to the reference position P. Accordingly, the return force is set so as to increase in accordance with the amount of either forward or backward movement of the seat 2 from the reference position P. With such a configuration, the seat 2 can stop at an appropriate position in a balanced manner, or the assist force for allowing a sitting person to change his/her posture can be obtained from the return force generation mechanism 4. Consequently, according to the chair of the present invention, the sitting person can be appropriately seated not only in a normal sitting posture in a state where the chair is located at or adjacent to the reference position P or in a backward tilted posture when the seat is moved backward, but also in a forward tilted posture when the seat is moved forward. As a result, the chair allowing the sitting person not to easily get tired even when being seated for a long time can be realized.

Further, the reference position P is located midway in the front-back movable range, and is a position when a person is not seated, and the seat 2 is stationary on that the elastic force in the front-back direction is zero or balanced at the reference position P. Consequently, the smooth behavior of the seat located from a position adjacent to the reference position P can be effectively realized, and in addition, at the time of the forward or backward movement of the seat from the reference position P, an initial reaction force can be appropriately applied.

Further, the return force generation mechanism 4 is configured to variably adjustable an elastic biasing force. Therefore, even if the force required to return the seat to the reference position P increases in accordance with the increase of the physical size of a sitting person, the return force can be adjusted by the adjustment in accordance with the physical size or preference of the sitting person.

Moreover, as illustrated in FIG. 5A, the cylinder 40 as a single elastic member realizes for applying an elastic biasing force toward the reference position P when the seat 2 is located forward of the reference position P, and a mechanism for applying an elastic force toward the reference position P when the seat 2 is located backward of the reference position P. Therefore, the number of components of the cylinder 40 or the like as the elastic member can be reduced, and in addition, the basic function of the present invention can be simply configured.

Also, as illustrated in FIGS. 5B1 to 5B3, the chair is provided with: the cylinder 41 as an elastic member configured to apply an elastic biasing force toward the reference position P when the seat 2 is located forward of the reference position P; and the cylinder 42 as an elastic member configured to apply an elastic force toward the reference position P when the seat 2 is located backward of the reference position P. The elastic biasing forces are separately set. In such a case, even for the same sitting person, the way that the center of gravity shifts downward at the time of the forward movement of the seat differs from the way that the center of gravity shifts downward at the time of the backward movement of the seat. Therefore, likewise, the force required to return the seat at the time of the forward movement differs from the force required to return the seat at the time of the backward movement. However, with the above-mentioned configuration, an appropriate usage environment can be offered suitably with each of directions.

Additionally, in FIG. 1, a portion of supporting positions of the shafts n1 to n4 is changed in the front-back direction and thereby an initial displacement of the elastic member may be changed so that the elastic biasing force is variably adjustable.

Further, as illustrated in FIG. 6, the initial position of the elastic member is changed so that the displacement of the elastic member 40 due to the positional change of the seat 2 is changed; therefore, repelling force properties of the elastic member 40 are variably adjustable. In such a case, without changing the reference position, a return force can be changed by changing a lever ratio.

Furthermore, as in the first embodiment, the backrest 3 is provided backward of the seat 2, and the backrest 3 and the seat 2 are movable in conjunction with each other in the front-back direction. In this case, the seat 2 is configured such that a movement end inclines downward in accordance with the amount of movement. Therefore, the chair with appropriate usability including a forward or backward tilted posture can be realized.

Moreover, the seat 2 is movably supported in the front-back direction and the left-right direction by the front-back movement mechanism 6 and the left-right movement mechanism 7 that are separate mechanisms. The separate return force generation mechanism 5 for left-right direction is also provided. Therefore, the seat 2 is independently movable not only in the front-back direction and but also in the left-right direction. In addition, the separate return force generation mechanism 4, 5 for left-right direction is provided. Therefore, the seat 2 can be smoothly moved and more various usages of the seat 2 can be offered.

In this case, the left-right return force generation mechanism 7 is configured to shift the center of gravity of the seat 2 upward in accordance with the movement of the seat 2 from the reference position P. When the seat 2 is located at the reference position P, the center of gravity of the seat is located at the lowest position. When the seat 2 is moved right or left, the center of gravity is shifted upward. Thus, without the application of an elastic member or the like, a return force due to gravity can be automatically obtained. Also, the return force is appropriately suitable for the weight of a sitting person.

In addition, the foregoing elastic member is not limited to a spring.

Second Embodiment

Next, an example where an extension spring is applied to an elastic member configuring an elastic return mechanism will be described with reference to FIGS. 8 to 12.

The chair according to a second embodiment of the present invention is different from the chair according to the first embodiment mainly in a front-back movement mechanism 206 and a first elastic force return mechanism 204 for front-back direction, and is substantially the same as the chair according to the first embodiment regarding the left-right movement mechanism and the second return force generation mechanism for left-right direction. Therefore, differences will be mainly described below.

The front-back movement mechanism 206 includes a front link member 261 having a lower end pivotally supported around a left-right shaft s1 by a support base 212, and a guide hole t1 provided in the support base 212 and formed in an upward recessed shape inclined downward from the front side toward the back side. With respect to the illustrated seating part 2 located at the reference position P, an upper end of the front link member 261 is attached in a forward tilted posture to a bracket 221 at the front end of the seat 2 to be pivotal around a left-right shaft s3. An intermediate position of the guide hole t1 is engaged with a left-right shaft s4 provided at the back end of the seat 2. In other words, when the seat 2 is moved forward from the reference position P as illustrated from a state of FIG. 9 to a state of FIG. 10, the front link member 261 is brought into a further forward tilted posture and the left-right shaft s3 is moved.

In addition, the left-right shaft s4 located on the back side is lifted forward and upward along the guide hole t1. Thus, the seat 2 is tilted forward. Meanwhile, when the seat 2 is moved backward from the reference position P as illustrated from a state of FIG. 9 to a state of FIG. 11, the front link member 261 is brought into an upright posture and the left-right shaft s4 located on the back side is moved backward and downward. Thus, the seat 2 is tilted backward.

In addition, the first return force generation mechanism 204 is configured such that an extension spring 241 as a single elastic member realizes a mechanism for applying an elastic biasing force toward the reference position P when the seat 2 is located forward of the reference position P, and a mechanism for applying an elastic force toward the reference position P when the seat 2 is located backward of the reference position P. The spring 241 is attached between a link member 263 provided continuously with the upper end of the link member 261 to integrally rotate with the link member 261 around the left-right shaft s3, and a bracket 222 provided on a lower surface of the seat 2. When the seat 2 is moved forward as illustrated from a state of FIG. 9 to a state of FIG. 10, the spring 241 is pulled in a bent manner such that the link member 263 and the spring 241 project upward. Therefore, the spring 241 stores a backward return force. Meanwhile, when the seat 2 is moved backward as illustrated from a state of FIG. 9 to a state of FIG. 11, the spring 241 is pulled backward in a bent manner such that the link member 263 and the spring 241 project downward. Therefore, the spring 241 stores a forward return force. In other words, even when the seat 2 is moved either forward or backward from the reference position P, the spring 241 is pulled. In addition, the reference position is obtained in a state where the link member 263 and the spring 241 are linearly arranged.

As described above, the chair according to the second embodiment includes the return force generation mechanism 204 configured to generate a return force in a direction to return the seat 2 moved from the reference position P at least in the front-back direction to the reference position P. The return force generation mechanism 204 includes the spring 241 as the elastic member configured to increase the return force for returning the seat to the reference position P as the amount of movement of the seat from the reference position P increases. Therefore, the appropriate return force is obtained from the return force generation mechanism 204. Consequently, a sitting person can be appropriately seated not only in a normal sitting posture in a state where the seat is located at or adjacent to the reference position P or in a backward tilted posture when the seat is moved backward, but also in a forward tilted posture when the seat is moved forward. As a result, the chair allowing a sitting person not to easily get tired even when being seated for a long time can be realized.

Also, in the chair according to the second embodiment, the single elastic member 204 realizes a mechanism for applying an elastic biasing force toward the reference position P when the seat 2 is located forward of the reference position P, and a mechanism for applying an elastic force toward the reference position P when the seat 2 is located backward of the reference position P. Therefore, the number of components of the elastic member can be reduced, and in addition, the basic function of the present invention can be simply configured. Further, the extension spring is applied and thereby a large movable range can be secured and a flexible movement can be realized.

Furthermore, the chair according to the second embodiment includes an initial position adjustment mechanism 40*z*2 configured to change an initial position of the spring 241 as the elastic member. The initial position adjustment mechanism 40*z*2 is provided with a function to move up/down the bracket 222 supporting the spring 241 and change an attachment position of the spring 241 to the bracket 222. In accordance with the adjustment of the attachment position of the spring, the link member 263 is rotated together with the link member 261 from a state of FIG. 9, and the horizontal shaft s4 located on the back side is moved backward and downward along the guide hole t1. Therefore, the reference position P of the seat 2 shifts backward.

Thus, the reference position is effectively adjustable with the use of the return force adjustment mechanism 204.

Also, an initial displacement of the elastic member may be surely changed to change the reference position.

Figure 13:
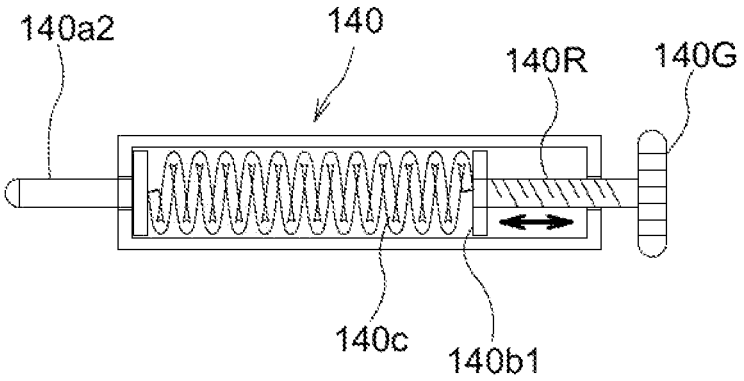
FIG. 13 is a drawing illustrating a modified example of the present invention.

Moreover, as illustrated in FIG. 13, a grip 140G is operated to project or retract a retainer 140*b*1, and thereby an initial compressed state may be changed to change the amount of an initial compression of a spring 140*c* of a cylinder 140. In FIG. 13, the grip 140G and the retainer 140*b*1 are connected by a threaded shaft 140R having an external thread, and the external thread of the threaded shaft 140R is screwed with an internal thread provided on the cylinder 140. Thus, a spring reaction force according to the amount of operation of the grip can be applied to a rod 140*a*2. Such a configuration is effectively applicable to the cylinder of FIG. 5A or the like.

Some embodiments of the present invention are described above; however, specific configurations of respective components may not be limited only to the foregoing embodiments. Various modifications can be made to the configurations without departing from the scope of the present invention.

For example, the reference position is not necessarily balanced at an intermediate position in the front-back direction and may be obtained in such a way that the seat is elastically pressed at a front limit position in a movable range. In this case, the chair is configured so as not to be movable forward from the reference position.

INDUSTRIAL APPLICABILITY

The present invention is applicable to a chair suitably used in an office or the like.

DESCRIPTION OF REFERENCE NUMERALS

P: reference position
2: seat
4: first return force generation mechanism (front-back direction)
40, 41, 42: elastic member
5: second return force generation mechanism (left-right direction)

The invention claimed is:

1. A chair configured to be movable in the front-back direction and in a left-right direction and having a reference position located midway in a front-back direction and in a left-right direction in a movable range of a seat, the chair comprising:

a first return force generation mechanism configured to generate a return force in a direction to return the seat moved from the reference position in the front-back direction to the reference position; and a second return force generation mechanism configured to generate a return force in a direction to return the seat moved from the reference position in the left-right direction to the reference position, wherein the first return force generation mechanism comprises an elastic member configured to increase the return force in the direction to return the seat to the reference position as an amount of movement of the seat from the reference position increases, wherein the second return force generation mechanism is configured to shift the center of gravity of the seat upward in accordance with the movement of the seat from the reference position, wherein regardless of whether the seat moves front, back, left or right, a movement end of the seat inclines downward in accordance with the amount of movement of the seat.

2. The chair according to claim 1, wherein in the first return force generation mechanism, the reference position is located midway in the front-back direction in the movable range and is a position when a person is not seated, and the seat is stationary on that the elastic force in the front-back direction is zero or balanced at the reference position in the front-back direction.

3. The chair according to claim 1, wherein the first return force generation mechanism is configured to variably adjust an elastic biasing force.

4. The chair according to claim 1, wherein the elastic member of the first return force generation mechanism comprises a first elastic member for applying an elastic biasing force toward the reference position when the seat is located forward of the reference position, and a second elastic member for applying an elastic biasing force toward the reference position when the seat is located backward of the reference position.

5. The chair according to claim 1, wherein the first return force generation mechanism includes a single elastic member for applying an elastic biasing force toward the reference position when the seat is located forward of the reference position, and for applying an elastic biasing force toward the reference position when the seat is located backward of the reference position.

6. The chair according to claim 1, wherein the first return force generation mechanism includes a front link member having a lower end pivotally supported around a left-right shaft n1 by a casing, and a back link member having a lower end pivotally supported around a left-right shaft n2 by the casing, and the seat is attached to upper ends of the front link member and the back link member via left-right shafts n3 and n4, wherein a portion of supporting positions of the left-right shafts n1, n2, n3 and n4 can be changed in the front-back direction such that an initial displacement of the elastic member is changed to make an elastic biasing force variably adjustable.

7. The chair according to claim 1, wherein the first return force generation mechanism includes a front link member having a lower end pivotally supported around a left-right shaft n1 by a casing, and a back link member having a lower end pivotally supported around a left-right shaft n2 by the casing, and the seat is attached to the upper ends of the front link member and the back link member via the left-right shafts n3 and n4, wherein a first contact plate and a second contact plate are configured to be integrally pivotal with the back link member and the front link member, respectively, so as to be configured to vary a distance from the left-right shaft n1 to the portion of the first contact plate to be brought into contact with the elastic member and a distance from the left-right shaft n2 to the portion of the second contact plate to be brought into contact with the elastic member, such that an initial position of the elastic member is changed to change the displacement of the elastic member due to the positional change of the seat to make repelling force properties of the elastic member variably adjustable.

8. The chair according to claim 1, wherein the first return force generating mechanism is configured to shift the reference position to a position where the elastic force in the front-back direction is zero or balanced by changing the initial displacement of the elastic member.

9. The chair according to claim 1, comprising a backrest located backward of the seat, wherein the seat and the backrest are movable in conjunction with each other in the front-back direction, and a movement end of the seat inclines downward in accordance with the amount of movement of the seat.

10. The chair according to claim 7, wherein the first return force generating mechanism is configured to shift the reference position to a position where the elastic force in the front-back direction is zero or balanced by changing the initial position of the elastic member.

11. The chair according to claim 1, wherein the second returning force generating mechanism is composed of a pair of link members.

12. The chair according to claim 11, wherein the pair of link members have a stable position at a portion that holds the object to be suspended by gravity at the lowest position, and regardless of the moving direction from this position to the left or right, the tip side in the moving direction is tilted downward and the center of gravity of the seat is raised with generating a return force in accordance with the above accordingly.

* * * * *